United States Patent [19]

Schuurman

[11] 4,325,428

[45] Apr. 20, 1982

[54] HEAT EXCHANGER

[75] Inventor: Pieter J. Schuurman, The Hague, Netherlands

[73] Assignee: Shell Oil Company, Houston, Tex.

[21] Appl. No.: 112,261

[22] Filed: Jan. 15, 1980

[30] Foreign Application Priority Data

Jan. 30, 1979 [NL] Netherlands ..... 7900710

[51] Int. Cl.[3] ..... F28F 9/02

[52] U.S. Cl. ..... 165/72; 165/158; 285/137 R; 285/412

[58] Field of Search ..... 165/162, 158, 72, 163, 165/176; 285/137 R, 187, 412; 248/200

[56] References Cited

U.S. PATENT DOCUMENTS

| | | | |
|---|---|---|---|
| 2,060,078 | 11/1936 | Hobbs | 165/72 |
| 2,061,980 | 10/1936 | Price | 165/158 |
| 3,588,767 | 6/1971 | Hass | 248/200 |

*Primary Examiner*—Albert W. Davis

[57] ABSTRACT

Tube and plate heat exchangers for power recovery (cat.-cracker) purposes are improved by securing the tube plate with a two-parts gland flange, which flange is fastened with a loose bolt and nut connection, the bolts being secured by special split rings.

6 Claims, 5 Drawing Figures

FIG. 2
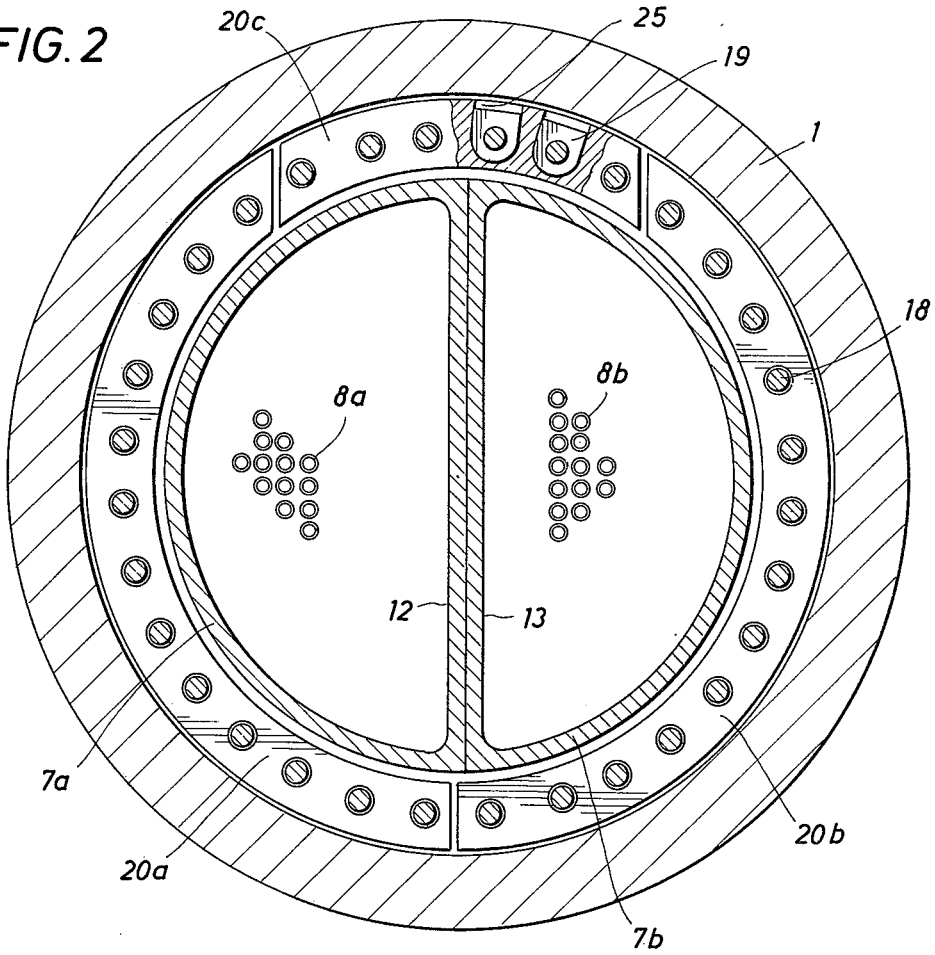
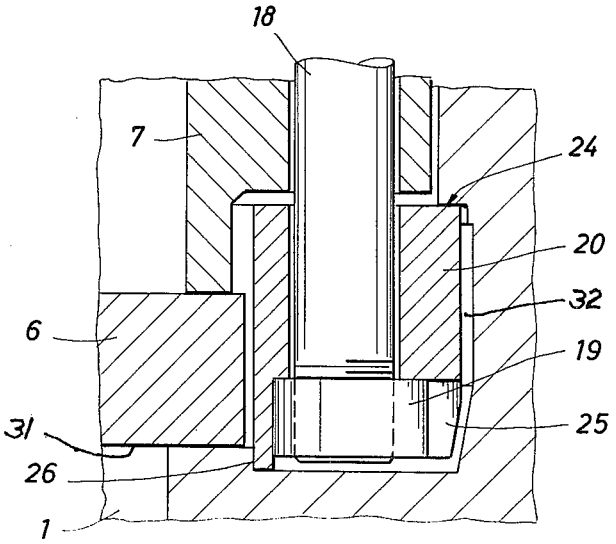
FIG. 3

HEAT EXCHANGER

The invention relates to a heat exchanger provided with a bundle of parallel tubes secured at the end of a tube plate which tube plate is held in place in the heat exchanger by means of a gland flange.

Such heat exchangers of the type known as "closed", where the one medium flows around the tubes and the other, heat exchanging, medium is passed through the tubes, are extensively used in the process industry, frequently operating at considerable pressures of several tens of atmospheres.

This circumstance imposes high requirements on the sealing of the detachable parts, which must be removed for the purpose of cleaning or inspection and which subsequently must be reliably resealed. Such securing is generally effected with the aid of stud bolts and nuts, which are often made of stainless steel. The number and dimensions of these are increasing considerably in proportion to the increase in the pressure and capacity and thereby in the dimensions of the heat exchangers. As a consequence of the high pressures and temperatures prevailing in such heat exchangers during operation, difficulties may occur, particularly if stainless steel stud bolts and nuts are employed. Especially stainless steel threaded connections may, particularly when being undone after a period of service, sustain damage to the threads, this phenomenon being also designated by specialists as a tendency to gall. As a result, time-consuming and costly repair work may be necessary, particularly if such damage occurs where the stud bolts intended to secure the tube plate are screwed in. The latter is located inside the heat exchanger and it may therefore be difficult to gain access to its securing means.

SUMMARY OF THE INVENTION

The invention now aims to avoid the above-mentioned disadvantage by the use of bolts without, however, any extra space being required for them and without this leading to the diameter of the heat exchanger's shell being enlarged at the open end where the cover is fitted.

To this end, the invention consists of a heat exchanger of the type mentioned in the preamble, characterized in that the gland flange is secured by means of bolts which press the gland flange by way of a supporting element against a collar in the heat exchanger's shell.

In accordance with the invention, the bolts, which are fitted through an annulus of holes in the gland flange, can each be held, at that side of the gland flange which faces the tube plate, in a recess of a divided ring located adjacent to the tube plate and confined between the collar in the heat exchanger's shell and a projecting edge of the heat exchanger's shell.

The head of a securing bolt, which is held in the recess of the divided ring is preferably adapted to the shape of the recess so that it is blocked against rotation.

The divided ring can now be easily fitted in the heat exchanger and the bolt, of adapted shape, can be placed in the recess so that, for the gland flange to be secured, an annulus of bolts is already correctly positioned without it being necessary to hold these bolts in position with special tools. The gland flange may consist of two detachable symmetrical halves in order to enable them to be inserted in the heat exchanger through the open end where the cover is fitted. The halves are then brought into place separately and then bolted to one another at the central partition, which also acts as a baffle.

In accordance with another embodiment of the heat exchanger according to the invention, the bolts, which are fitted through an annulus of holes in the gland flange, may further be guided through recesses in the collar section of the heat exchanger's shell and be supported by means of a divided ring against the collar in the heat exchanger's shell.

This embodiment, the manufacturing cost of which might be a drawback if walls lined with stainless steel are used, can at least be used where no separate linings are employed.

BRIEF DESCRIPTION OF THE DRAWING

The invention will now be elucidated in greater detail with the aid of the drawing, in which:

FIG. 2 is a cross-section taken along the II—II in FIG. 1;

FIG. 3 represents a detail of the embodiment in accordance with FIG. 1 on a larger scale;

and

Figure 4:
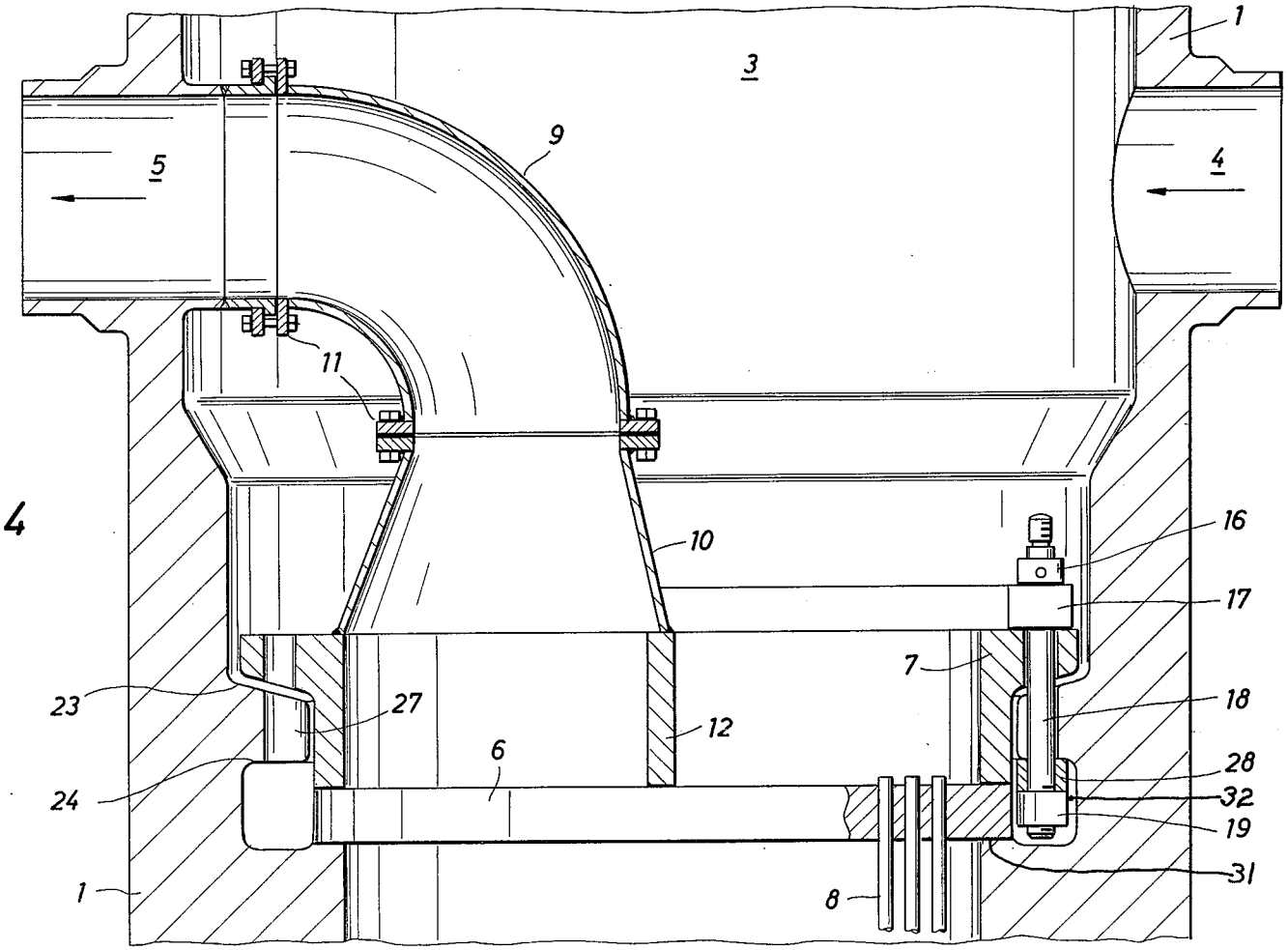
FIG. 4 is a cross-section similar to that of FIG. 1, except that the cover section is omitted, of an alternative embodiment of the heat exchanger in accordance with the invention.
Figure 5:
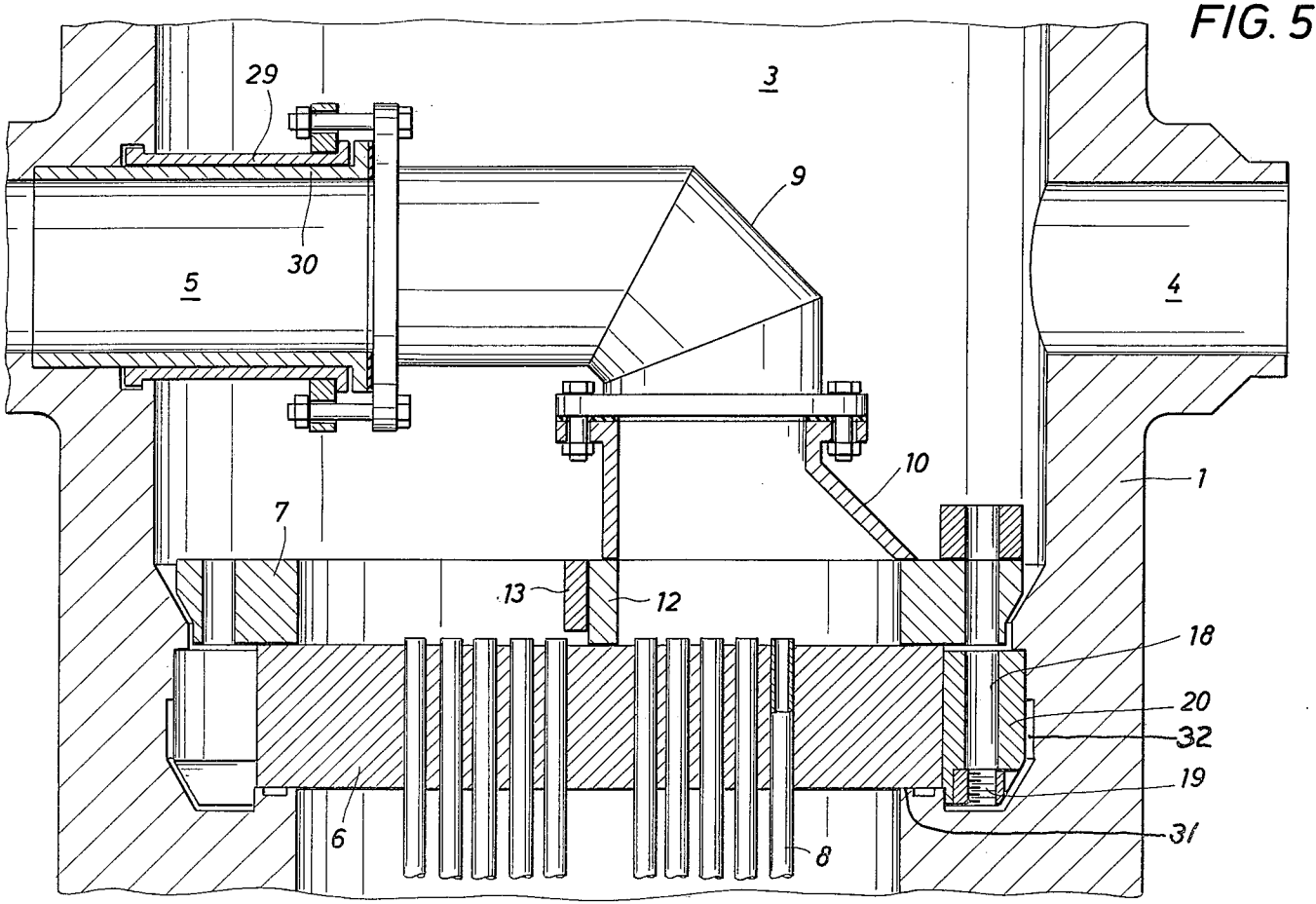

FIG. 5 is a cross-section similar to that of FIG. 4 of still another alternative embodiment.

Identical or analogous parts of the various design versions are given the same reference numbers in the drawings.

DESCRIPTION OF A PREFERRED EMBODIMENT

Figure 1:
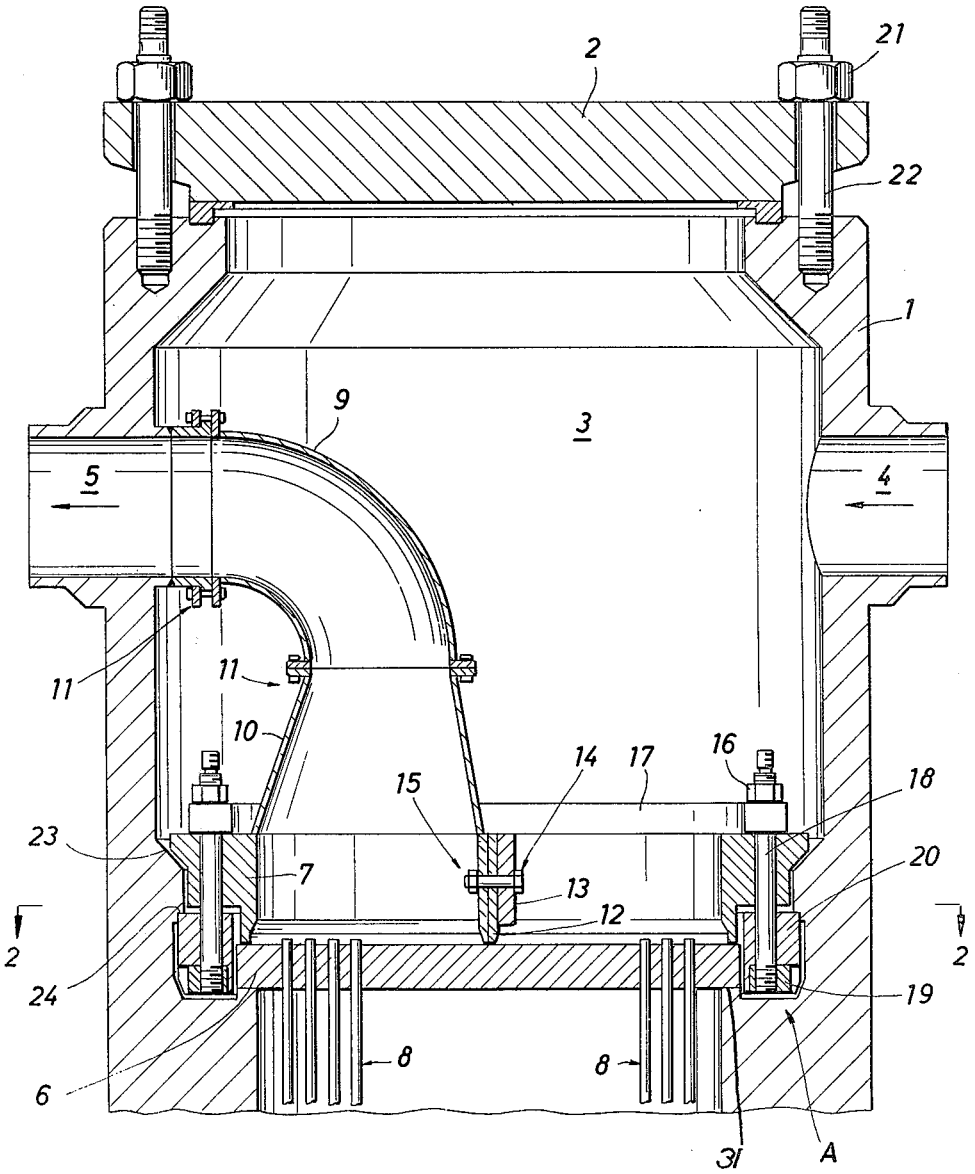
FIG. 1 is a cross-section of a part of a heat exchanger in accordance with the invention.

In the embodiment in accordance with FIGS. 1 to 3, the heat exchanger consists of a shell 1, closed by a cover 2 and secured by means of stud bolts and nuts 22 and 21. Beneath the cover there is a header chamber 3 to which are connected an inlet 4 and outlet 5 for the medium to be passed through the tubes of the heat exchanger, which medium is generally the heat-receiving medium. In a tube plate 6 the ends of the tubes of a tube bundle 8 are accommodated. The tube plate 6 is held by a gland flange 7 against a seating surface 31 formed on the inner wall of the shell 1, which surface 31 has a diameter less than that of tube plate 6. The connection between the outlet 5 and the discharge section of the tube bank is formed by a bend 9 and a cone 10, the latter abutting onto the usually semicircular admission section of the tube plate 6, which section is formed by one-half (*7a*, see FIG. 2) of the gland flange 7 and a baffle 12 diametrally fitted in the middle.

The attachment of the bend 9 to the outlet, as well as the connection between bend 9 and cone 10, is effectuated with the aid of flanges 11, secured to one another by bolts. The gland flange 7 consists of two parts *7a* and *7b* which are secured to one another in the middle by the baffle 12 abutting against an intermediate strip 13 which are secured to one another by means of nut and bolt connections 14, 15. The gland flange 7 consists of two halves to enable it to be assembled or disassembled, or to be fitted into or removed from the heat exchanger by way of the open and where the cover is fitted.

As regards the tube bundle 8, it is to be noted that the tubes of the bundle can, for example, be U-shaped, running from the admission half of the tube plate to the discharge half. They can also be straight pipes debouching at the other end in a floating tube plate with header in accordance with an in itself known construction. These various possibilities are not shown in the drawings as these do not form part of the present invention.

As far as the securing of the gland flange 7 to hold the tube plate 6 is concerned the following provision has been made in accordance with the invention.

The shell 1 is provided with a landing shoulder or collar section 23 of increased wall thickness with a lower downwardly facing slating surface or collar surface 24 against which presses a supporting element in the form of a divided ring 20. In the given example, this ring consists of three parts 20*a*, 20*b* and 20*c* (see FIG. 2) so that the ring can be fitted behind or below the collar section 23 against the collar surface 24 in a circumferential recess 32 formed in the inner surface of the wall of the shell 1.

The rings are namely supported at the upper edge of their outer circumference against the collar 24 and at the lower edge of their inner circumference by a projecting edge 26 of the shell, and so are thereby confined to prevent tilting as a result of the moments in the vertical plane due to the bolts 18. The ring 20 may also consist of more parts than are shown in this example.

The ring 20 has, distributed over its circumference, a number of recesses 25, in which nuts 19 are placed, fitting inside them in such a way that they cannot turn. Threaded studs fit into these nuts, forming together with these nuts the bolts 18 which each fit through a hole in the ring 20 and in the gland flange 7. A nut 16 at the other end of the bolt 18 completes the fastening. The ring 20, bolts 18 and nuts 16 and 19 form one arrangement of connector means between the shell 1 and the tube place 6 for enclosing the plate and its tube bundle within the shell.

It is of course also possible to manufacture the threaded stud together with nut 19 as one integral unit, but it is more economical to manufacture them separately and then, possibly after the nut has been fitted to secure them to one another by means of a spot weld.

The coefficients of expansion of the botls 18, tube plate 6, and gland flange 7 should be the same magnitude. If the magnitude of the coefficient of expansion of the shell 1 differs significantly from those of the above-named parts, so that at high operating temperatures inadmissibly high stresses arise as a result of these differences, a compensating ring 17 should be used to eliminate these high stresses. If the magnitudes of the coefficients of expansion of the shell 1, compensating ring 17 and ring 20 are the same, this is achieved by making the bolt length between the nut 16 and the nut or bolt head 19 equal to the sum of the thickness of the tube plate 6 and the gland flange ring 7. Instead of a compensating ring, a number of compensating bushes can also be fitted, one around each bolt.

For protection purposes, the compensating ring 17 and the nut 19 will in many cases be provided with a coating.

It is to be noted that the divided ring 20 is in practice arranged to fit with the aid of a spacer ring (not shown in the drawing) between the collar surface 24 and the abutting part of the ring 20.

The embodiment in accordance with FIG. 4 is of a somewhat different construction. In this figure, the same cross-section is illustrated as in FIG. 1, but with the cover section omitted. The duty of a supporting element in the shape of a divided ring 20 with recesses 25 is in principle taken over by the collar section 23 of the shell 1, in which recesses 27 are now located (FIG. 4, left-hand side). In these recesses fit the threaded studs plus nuts 19, which are then designated together as bolt 18, with another supporting ring 28 being present between the nut (or bolt head) and the collar section, which ring may also be replaced by a supporting bush for each bolt.

Both in the embodiment of FIG. 1 and in that of FIG. 4, the securing of the gland flange with the aid of the bolts is shown, for the sake of simplicity, in the right-hand half of the Figure only.

The embodiment in accordance with FIG. 5, finally, is virtually identical to that of FIG. 1 but with the difference that the connection between the tube plate 6 and the outlet 5 is made in a different way. The bend 9 consists of a number of uncurved welded parts, whereby more effective use is made of the space, i.e., less space is needed than in the case of a curved bend. As a result, the heat exchanger can be more compact, which means a substantial cost-saving. Moreover, the connection to the outlet and the seal are effectuated with the aid of a bush 29, provided at either end with a small flange, and an inner bush 30. The seal is made between the end flange of the inner bush and the flange of the bend 9, and the fastening by means of bolts through this flange and a flange ring abutting against the outer flange of the ring 29. In the given example, a "cross-over" is made to the right hand side of the heat exchanger, which, particularly in the case of small dimensions, offers the most practical solution.

I claim as my invention:

1. A heat exchanger comprising:

an outer shell or housing adapted to be opened at one end for installing a tube bundle therein, a tube bundle of a plurality of parallel tubes, a tube plate having the ends of the parallel tubes secured thereto and being of a diameter to be positioned within the shell, a seating surface formed on the inner wall of said shell and displaced axially from the open end thereof, said seating surface forming stop means against which the tube plate of the tube bundle can be pressed, said seating surface having a diameter less than that of the tube plate, collar means formed on the inner wall of said shell above or to the open-end side of said seating surface and being displaced axially from the open end thereof a distance less than that of said seating surface, said collar means having a diameter greater than that of said tube plate, a gland flange positioned against one side of the tube plate while the opposite side of the tube plate is positioned on said seating surface in the shell, and connector means operatively carried within the outer shell of the heat exchanger for securing the tube plate and land flange to the inner wall of said shell adjacent said collar means.

2. Heat exchanger as claimed in claim 1, including securing bolts in said connector means, each of the bolts being fitted through an annulus of holes formed in the gland flange, and being held, on the side of the gland flange facing the tube plate, in a recess of a divided ring, which is located adjacent to the tube plate and is confined between the collar in the shell and a projecting edge of the heat exchanger's shell.

3. Heat exchanger as claimed in claim 2, characterized in that the head of a securing bolt, which is held in the recess of the divided ring, is adapted to the shape of the recess so that it is blocked against rotation.

4. Heat exchanger as claimed in claim 1, including bolts in the connector means characterized in that which are fitted through an annulus of holes in the gland flange, are moreover guided through recesses in the collar section of the heat exchanger's shell and are supported by means of a divided ring against the collar in the heat exchanger's shell.

5. The apparatus of claim 1 including a cover secured to and closing the open end of said shell to form a closed chamber between said cover and said tube plate.

6. The apparatus of claim 5 including inlet and outlet conduit means through the shell wall.

* * * * *